US008240930B2

(12) United States Patent
Oshri

(10) Patent No.: US 8,240,930 B2
(45) Date of Patent: Aug. 14, 2012

(54) PERSONAL HYGIENE APPARATUS

(76) Inventor: Amnon Oshri, Orinda, CA (US)

( * ) Notice: Subject to any disclaimer, the term of this patent is extended or adjusted under 35 U.S.C. 154(b) by 403 days.

(21) Appl. No.: 12/550,092

(22) Filed: Aug. 28, 2009

(65) Prior Publication Data

US 2011/0052303 A1 Mar. 3, 2011

(51) Int. Cl.
*B43K 27/02* (2006.01)

(52) U.S. Cl. ..... 401/19; 401/17; 401/18; 132/314

(58) Field of Classification Search ..... 401/183–186, 401/200, 205, 206, 16, 17, 18, 19, 23; 132/314
See application file for complete search history.

(56) References Cited

U.S. PATENT DOCUMENTS 1,164,979 A * 12/1915 Benko ..... 401/18
3,682,558 A * 8/1972 Miller ..... 401/200
4,693,623 A * 9/1987 Schwartzman ..... 401/206
6,062,230 A * 5/2000 Kajgana ..... 132/116

* cited by examiner

*Primary Examiner* — David Walczak

(57) ABSTRACT

A personal hygiene apparatus including a container, a first storage compartment disposed within the container and configured to store a deodorant, a second storage compartment disposed within the container and opposite the first storage compartment, the second storage compartment configured to store a sanitizer solution, an applicator in fluid communication with the second storage compartment and configured to receive the sanitizer solution and an interface disposed between the second storage compartment and the applicator for regulating the supply of the sanitizer solution to the applicator.

10 Claims, 2 Drawing Sheets

PERSONAL HYGIENE APPARATUS

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates to a personal hygiene apparatus for application of a sanitizer solution in lieu of washing using water and soap.

2. Description of the Related Art

Deodorants and antiperspirants are substances applied to the body to reduce body odor caused by perspiration. There are many well known forms of deodorant including a deodorant stick, roll-on, gel, foam and aerosol spray which may be secured in a container. These types of deodorant may be applied to the body such as the underarm. However, the deodorant stick may be applied to other parts of the body as well to reduce body odor and possibly reduce perspiration in the case of an antiperspirant. Deodorants and antiperspirants may be alcohol based and thus may kill bacteria. However, deodorants are not typically substituted for soap and water cleaning. Deodorants may typically be used after washing using water and soap.

Alcohol rub, sometimes referred to as a hand sanitizer, hand wash or a hand antiseptic may be used as a supplement or alternative to hand washing with soap and water. Alcohol rub is available in many forms including gels, foam and liquid solutions. Alcohol rub may be more effective at killing germs than soaps. Alcohol rub which is also known as a sanitizing solution is considered an acceptable alternative to soap and water for personal hygiene.

Different dosing systems are available for hospital handrubs. Those are usually dosing systems incorporated into the bottle itself like dosing pumps screwed into the bottle or airless pump systems. The dosing systems are designed to deliver a certain amount of the hand sanitizer, and thus to assist staff to correctly measure out the correct dose. Application of the hand sanitizer can also be assisted by placing the bottle in specially designed dispensers typically equipped with an infrared sensor to avoid any contact with the pump.

An important way to prevent the transmission of dangerous diseases is to frequently wash hands with soap or use a hand sanitizer that contains at least 60 percent alcohol. Alcohol rubs kill many different kinds of bacteria, including antibiotic resistant bacteria and TB bacteria. Alcohol rubs inactivate many different kinds of viruses, including the flu virus and the common cold virus. Alcohol rubs also kill fungi. Thus, the use of a sanitizing solution when hand washing is not available or as an alternative to hand washing is often recommended. Hand washing may also cause the skin to dry. The use of a sanitizing solution may not cause the skin to dry.

Sanitizer solution is used mainly for hand sanitization. Hand sanitizers are commonly sold in stores in small portable dispensers that include pumps similar to dispensers used for hand wash soap. These types of dispensers appear to be well suited for application of the sanitizing solution on an individual's hands. However, these dispensers are not well suited for application of the sanitizing solution to other parts of the body.

Accordingly, there exists a need in the art for an improved personal hygiene apparatus for application of a sanitizing solution to all areas of the body.

SUMMARY OF THE INVENTION

A personal hygiene apparatus is provided with a container having a storage compartment for storing a sanitizer solution. The storage compartment includes an interface having a plurality of apertures that allows for the sanitizer solution to flow from the storage compartment to an applicator for quick application of the sanitizer solution onto various parts of the body in lieu of washing with water and soap.

In one embodiment, a personal hygiene apparatus is provided that includes a container with a first storage compartment disposed within the container and configured to store a deodorant. The personal hygiene apparatus also includes a second storage compartment disposed within the container and opposite the first storage compartment, the second storage compartment is configured to store a sanitizer solution. The personal hygiene apparatus has an applicator in fluid communication with the second storage compartment and configured to receive the sanitizer solution and an interface disposed between the second storage compartment and the applicator for regulating the supply of the sanitizer solution to the applicator.

An aspect of the personal hygiene apparatus includes a sponge applicator and may also be removable.

The interface of the personal hygiene apparatus may further include a plurality of apertures for facilitating transmission of the sanitizer solution from the second storage compartment to the applicator. The plurality of apertures may be elastic so that when pressure is applied to the second storage compartment, the sanitizer solution transmits through the plurality of elastic apertures until the pressure is removed. The plurality of apertures may also be evenly spaced.

An aspect of the personal hygiene apparatus includes the first storage compartment being removable from the container. The second storage compartment of the personal hygiene apparatus may also be removable from the container.

An aspect of the invention also includes an alcohol rub used for the sanitizer solution. The sanitizer solution may include a perfume fragrance. The deodorant may be any one of a solid, a gel, a roll-on and an aerosol spray. The deodorant may also be an antiperspirant.

In a second embodiment, the personal hygiene apparatus includes a container, a storage compartment disposed within the container and configured to store a sanitizer solution. An interface disposed on an end portion of the storage compartment is also provided. The interface includes a plurality of apertures. The personal hygiene apparatus also includes an applicator in fluid communication with the interface and configured to receive the sanitizer solution. Each aperture from the plurality of apertures on the interface includes a first opening on an interior portion of the storage compartment and a second opening on an exterior portion of the storage compartment. The first opening is less than the second opening to facilitate transmission of the sanitizer solution from the storage compartment to the applicator.

Further features of the present invention will become apparent from the following description of exemplary embodiments with reference to the attached drawings.

DESCRIPTION OF THE EMBODIMENTS

Figure 1:
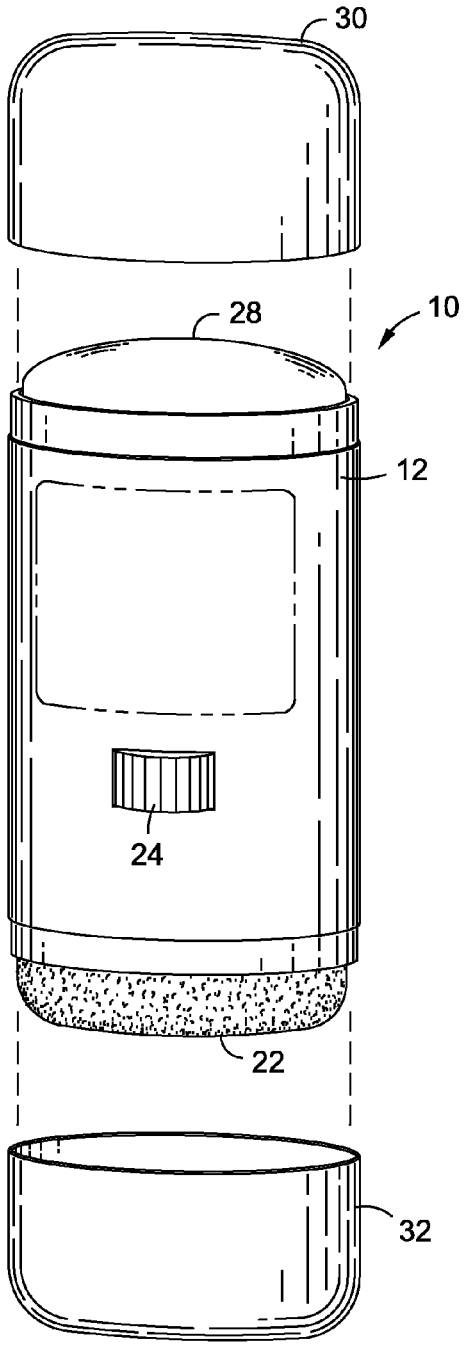
FIG. 1 is an exploded view showing an embodiment of a personal hygiene apparatus.
Figure 2:
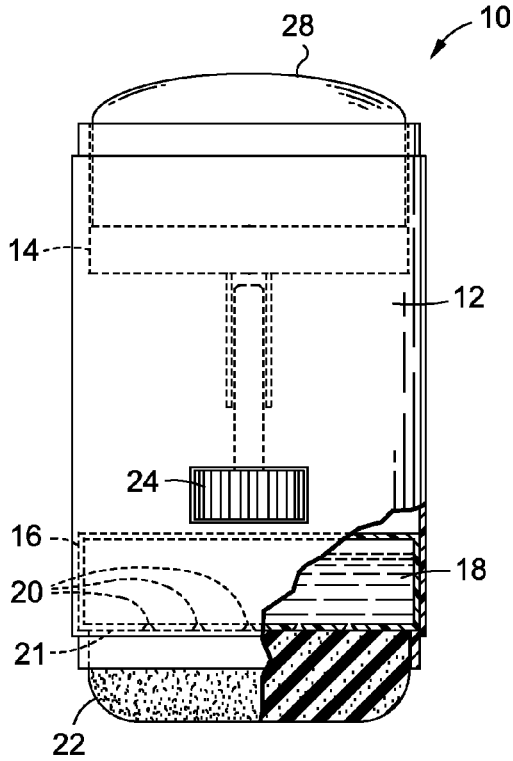
FIG. 2 is a schematic diagram showing the personal hygiene apparatus with a cut-away view.

With reference to FIGS. 1 and 2, a personal hygiene apparatus 10 is provided. The personal hygiene apparatus 10 uses an applicator such as a sponge applicator 22 for receiving a sanitizer solution 18 from a container 12 for quick application of the sanitizer solution 18 to various areas of the body. Additionally, the personal hygiene apparatus 10 may also include a deodorant 28 within the container 12 so that the deodorant 28 may be used in combination with application of the sanitizer solution 18. Thus, the personal hygiene apparatus 10 may be used to clean and refresh the body without the need for soap and water.

Attachable to the container is a cap 30 to be attached to one side of the container 12 of the personal hygiene apparatus 10. The cap 30 may be used as a cover for the deodorant 28 stored within the container 12 of the personal hygiene apparatus 10. A second cap 32 may be attachable to an opposite side of the container 32 to protect the sponge applicator 22 used to apply the sanitizer solution 18.

Figure 3:
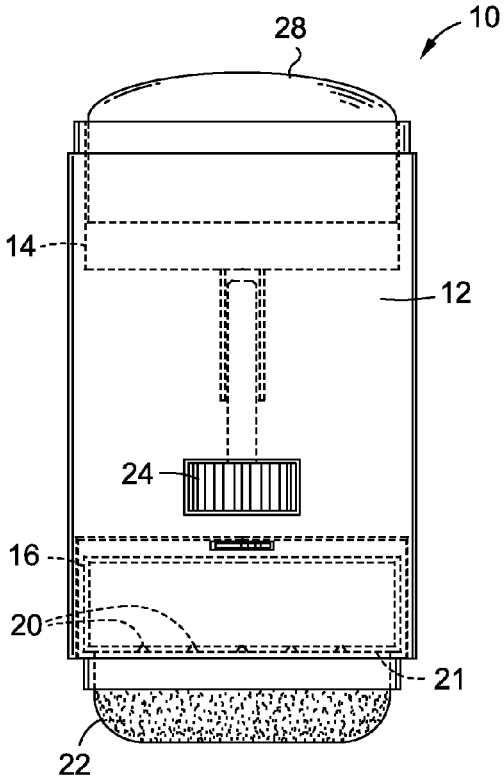
FIG. 3 is a schematic diagram showing the personal hygiene apparatus of FIG. 1.

Referring now to FIGS. 2 and 3, a schematic diagram illustrating the interior of the personal hygiene apparatus 10 is provided. The container 12 includes a first storage compartment 14. The first storage compartment 14 may be used to store the deodorant 28. Although the figures illustrate a deodorant stick 28 stored within the first storage compartment 14, this is by way of example and not of limitation. For example, a deodorant gel, roll-on or other well known deodorant type may be stored within the first storage compartment 14. In one aspect of the invention, the deodorant 28 is not stored within the first storage compartment 14. Instead, the personal hygiene apparatus 10 may omit the first storage compartment 14. In another example, the first storage compartment 14 may be used to store additional sponge applicators 22 for replacing a used sponge applicator 22.

Still referring to FIGS. 2 and 3, the personal hygiene apparatus 10 includes a driving mechanism 24 used to move the first storage compartment 14 up or down relative to the container 12. The driving mechanism 24 may include a screw or similar type of device to cause the first storage compartment 14 to move up and down similar to well known devices used for deodorant containers.

A second storage compartment 16 is provided within the container 12 of the personal hygiene apparatus 10. The second storage compartment 16 may be disposed opposite the first storage compartment 14. The second storage compartment 16 is configured to store the sanitizer solution 18. The second storage compartment 16 includes an interface 21 that is coupled to the sponge applicator 22. The interface 21 includes a plurality of apertures 20 that facilitate the flow of the sanitizing solution 18 from the second storage compartment 16 to the sponge applicator 22. The plurality of apertures 20 each include a first opening adjacent the interior of the second storage compartment 16 and a second opening adjacent the exterior of the second storage compartment 16. The first opening is smaller than the second opening for each aperture 20.

The first opening is smaller than the second opening for each aperture 20 on the interface 21 of the second storage compartment 16 so that once the sanitizer solution 18 exits the second storage compartment 16, the solution 18 is prevented from flowing back into the second storage compartment 16 and possibly contaminating the sanitizer solution 18 that is stored therein. Additionally, the first opening for each aperture 20 from the plurality of apertures 20 should be sufficiently small to prevent the sanitizer solution 18 from leaking onto the sponge applicator 22 when it is not desired. The sanitizer solution 18 should only flow through the plurality of apertures 20 when an external force or pressure is applied to the second storage compartment 16 when application of the sanitizer solution 18 via the sponge applicator 22 is desired.

In one aspect of the invention, the first opening adjacent the interior of the second storage compartment 16 for the plurality of apertures 20 on the interface 21 is elastic. An elastic first opening for each aperture 20 on the interface 21 of the second storage compartment 16 expands when an external pressure is applied to the second storage compartment 16. This facilitates the flow of the sanitizer solution 18 from the second storage compartment 16 to the sponge applicator.

Figure 4:
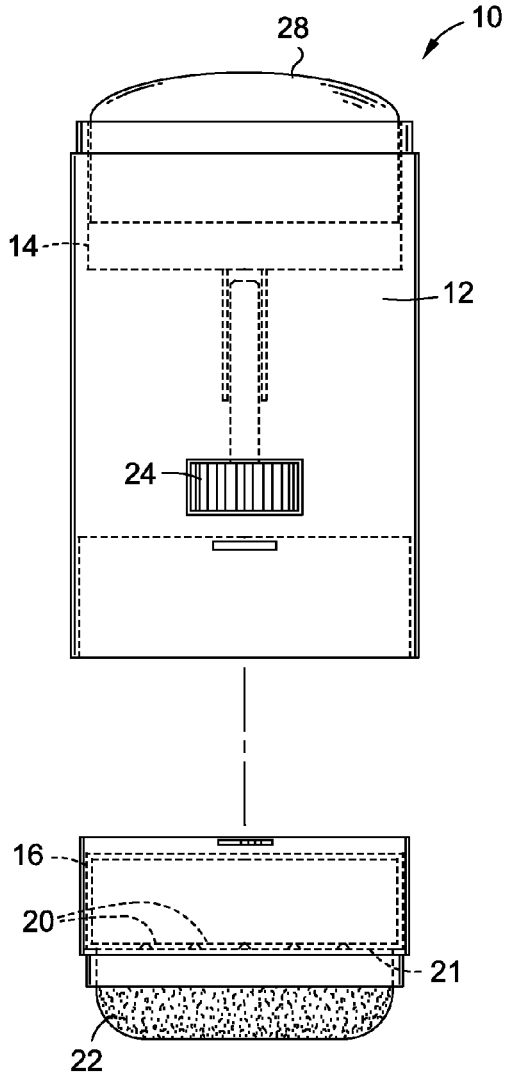
FIG. 4 is an illustration showing the personal hygiene apparatus with a storage compartment removed from a container of the personal hygiene apparatus.

Referring now to FIG. 4, the personal hygiene apparatus 10 is shown with a removable second storage compartment 16 attached to the sponge applicator 22. In this aspect of the invention, the second storage compartment 16 is configured to be removable from the container 12. In this regard, the second storage compartment 16 is also replaceable. In a case where there is no more sanitizer solution 18, the second storage compartment 16 with the sponge applicator 22 may be replaced. This allows for repeated use of the container 12 without having to throw away the container 12 when the sanitizing solution 18 is finished. Additionally, the ability to remove the second storage compartment 16 from the container 12 may make it easier for application of the sanitizing solution 18 to various parts of the body in a quick and efficient manner.

In another aspect of the present invention, the second storage compartment 16 is a squeezable container. In this regard, pressure or force used to squeeze the second storage compartment 16 may cause the sanitizer solution 18 to flow through the plurality of apertures 20 and onto the sponge applicator 22 for application onto the skin.

Figure 5:
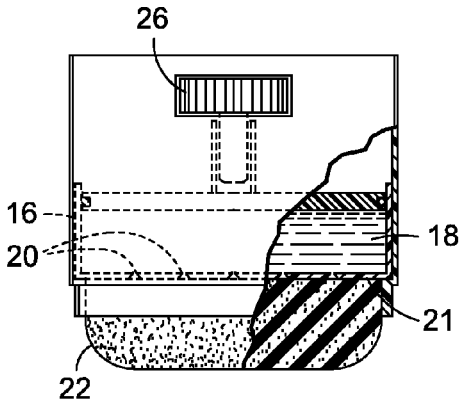
FIG. 5 is a cut-away view of a portion of the personal hygiene apparatus.

Referring now to FIG. 5, a second driving mechanism 26 may be provided. The second driving mechanism 26 may be used to exert a force or pressure upon the second storage container 16 sufficient to allow the sanitizer solution 18 to flow through the plurality of apertures 20 and onto the sponge applicator 22 for application onto the skin. As a result, the personal hygiene apparatus 10 may be used as an alternative to a traditional soap and water wash when a shower or bath is unavailable or significant time constraints require a quick method for the user of the personal hygiene apparatus 10 to clean their body.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A personal hygiene apparatus, comprising:

a container having a drive mechanism configured to displace a first storage compartment disposed within the container and storing a deodorant, when a user adjusts the drive mechanism;

a second storage compartment disposed within the container and opposite the first storage compartment, the second storage compartment storing a sanitizer solution, the second storage compartment being removably attachable to the container and made of a flexible material so that when the user of the apparatus squeezes the second storage compartment, the sanitizer solution is released from the second storage compartment;

an applicator in fluid communication with the second storage compartment and configured to receive the sanitizer solution; and an interface disposed between the second storage compartment and the applicator for regulating the supply of the sanitizer solution to the applicator.

2. The personal hygiene apparatus according to claim 1, wherein the applicator is a sponge applicator.

3. The personal hygiene apparatus according to claim 2, wherein the sponge applicator is removable.

4. The personal hygiene apparatus according to claim 1, wherein the interface includes a plurality of apertures for facilitating the transmission of the sanitizer solution from the second storage compartment to the applicator.

5. The personal hygiene apparatus according to claim 4, wherein the plurality of apertures are elastic so that when pressure is applied to the second storage compartment, the sanitizer solution transmits through the plurality of elastic apertures until the pressure is removed.

6. The personal hygiene apparatus according to claim 4, wherein the plurality of apertures on the interface are evenly spaced.

7. The personal hygiene apparatus according to claim 1, wherein the sanitizer solution is an alcohol rub.

8. The personal hygiene apparatus according to claim 1, wherein the sanitizer solution includes a perfume fragrance.

9. The personal hygiene apparatus according to claim 1, wherein the deodorant is one of a solid, a gel, a roll-on and an aerosol spray.

10. The personal hygiene apparatus according to claim 1, wherein the deodorant is an antiperspirant.

* * * * *